US011760113B2

(12) United States Patent
Iijima

(10) Patent No.: US 11,760,113 B2
(45) Date of Patent: Sep. 19, 2023

(54) PRINTING APPARATUS

(71) Applicant: BROTHER KOGYO KABUSHIKI KAISHA, Nagoya (JP)

(72) Inventor: Shota Iijima, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/512,646

(22) Filed: Oct. 27, 2021

(65) Prior Publication Data

US 2022/0134780 A1 May 5, 2022

(30) Foreign Application Priority Data

Oct. 30, 2020 (JP) ..... 2020-182336

(51) Int. Cl.

| | |
|---|---|
| ***B41J 11/00*** | (2006.01) |
| ***B41J 11/04*** | (2006.01) |
| ***B41J 15/02*** | (2006.01) |
| ***B41J 15/04*** | (2006.01) |
| ***B41J 29/02*** | (2006.01) |
| ***B41J 29/38*** | (2006.01) |
| ***B41J 3/36*** | (2006.01) |
| ***B41J 3/38*** | (2006.01) |
| ***B41J 3/39*** | (2006.01) |
| ***B41J 3/407*** | (2006.01) |

(52) U.S. Cl.

CPC ..... *B41J 11/04* (2013.01); *B41J 3/36* (2013.01); *B41J 3/382* (2013.01); *B41J 3/39* (2013.01); *B41J 11/005* (2013.01); *B41J 15/02* (2013.01); *B41J 15/044* (2013.01); *B41J 15/046* (2013.01); *B41J 29/02* (2013.01); *B41J 29/38* (2013.01)

(58) Field of Classification Search

CPC . B41J 11/005; B41J 11/04; B41J 15/02; B41J 15/044; B41J 15/046; B41J 29/02; B41J 29/38; B41J 3/36; B41J 3/382; B41J 3/39; B41J 3/4075

See application file for complete search history.

(56) References Cited

U.S. PATENT DOCUMENTS 4,770,550 A * 9/1988 Takahashi ..... G11B 15/29 384/49
6,042,280 A * 3/2000 Yamaguchi ..... B26D 5/00 400/615.2

FOREIGN PATENT DOCUMENTS

JP 2005-119318 A 5/2005
JP 2019015391 A * 1/2019

* cited by examiner

*Primary Examiner* — Justin Seo
*Assistant Examiner* — Kendrick X Liu
(74) *Attorney, Agent, or Firm* — Kenealy Vaidya LLP

(57) ABSTRACT

A printing apparatus including: a first roller mechanism including: a first shaft part having a first gear; and a first roller in which the first shaft part is inserted; and a second roller mechanism including: a movable holder configured to be moved in directions coming close to and being separated from a printing medium by a displacement mechanism; a second shaft part which is rotatably supported on the movable holder and having a second gear; a second roller in which the second shaft part is inserted, tiltable with respect to a shaft center of the second shaft part, and having an engaging groove recessed in an inner peripheral surface of an intermediate part of the second roller in a shaft center direction; and a protrusion protruding from an outer peripheral surface of the second shaft part and engaged with the engaging groove of the second roller.

11 Claims, 11 Drawing Sheets

PRINTING APPARATUS

CROSS-REFERENCE TO RELATED APPLICATIONS

This application is based upon and claims the benefit of priority from prior Japanese patent application No. 2020-182336, filed on Oct. 30, 2020, the entire contents of which are incorporated herein by reference.

TECHNICAL FIELD

The present disclosure relates to a printing apparatus, and particularly, to a printing apparatus including a conveying unit configured to convey a printing medium.

BACKGROUND ART

Related art discloses a printing apparatus configured to prepare a tape-shaped label suitable for adhesion to a spine of a file, for example.

As the printing apparatus, known is a label preparing apparatus configured to print, on a tape-shaped printing medium, a character, a pattern and the like which are input using an input means such as a keyboard by a print head and an ink ribbon.

In the label preparing apparatus, as a conveying mechanism configured to convey the printing medium toward the print head, known is a mechanism including a first roller mechanism having a platen roller, a second roller mechanism having a sub-roller arranged downstream of the first roller mechanism with respect to a conveying direction, and a displacement mechanism configured to displace the first and second roller mechanisms to come close to and to be separated from the print head.

However, in the above-described sub-roller, it is necessary to mount an aligning mechanism on the sub-roller so as to deal with a change in load when coming close to the printing medium. In addition, in order to deal with a printing medium having a large width, it is possible to increase axial lengths of the platen roller and the sub-roller. In this case, when strength of the aligning mechanism is insufficient, a roller shaft configured to rotatably support the sub-roller is distorted, resulting in poor conveyance.

SUMMARY

An aspect of the present disclosure provides a printing apparatus capable of reducing concern about occurrence of poor conveyance even in a case of performing printing by conveying a printing medium having a large width.

According to an aspect of the present disclosure, there is provided a printing apparatus including a conveying unit, a print head, and a displacement mechanism. The conveying unit is configured to convey a printing medium. The conveying unit includes a first roller mechanism and a second roller mechanism. The second roller mechanism is arranged downstream of the first roller mechanism with respect to a conveying direction. The print head is configured to perform printing on the printing medium being conveyed by the conveying unit. The displacement mechanism is configured to displace the first roller mechanism and the second roller mechanism to a close position at which the first roller mechanism and the second roller mechanism are close to the print head and to a separated position at which the first roller mechanism and the second roller mechanism are more distant from the print head than at the close position. The first roller mechanism includes a first shaft part and a first roller. The first shaft part is rotatably supported. The first shaft part is rotatable about a first shaft center extending in a first shaft center direction. The first shaft part has a first gear at a portion on a first side along the first shaft center direction. The first roller is rotatably supported. The first shaft part is inserted in the first roller. The first roller is configured to be moved in directions coming close to and being separated from the print head by the displacement mechanism. The second roller mechanism includes a movable holder, a second shaft part, a second roller, and a protrusion. The movable holder is configured to be moved in directions coming close to and being separated from the printing medium by the displacement mechanism. The second shaft part is rotatably supported on the movable holder. The second shaft part is rotatable about a second shaft center extending in a second shaft center direction. The second shaft part has a second gear at a portion on the first side along the second shaft center direction. The second roller has a hollow cylindrical shape. The second shaft part is inserted in the second roller. The second roller is tiltable with respect to the second shaft center of the second shaft part. The second roller has an engaging groove recessed in an inner peripheral surface of an intermediate part of the second roller in the second shaft center direction. The protrusion protrudes from an outer peripheral surface of the second shaft part and is engaged with the engaging groove of the second roller.

According to the above-described aspect, the first roller mechanism and the second roller mechanism are provided along a conveying path of the conveying unit. The first roller mechanism includes the first roller in which the first shaft part is inserted, and the second roller mechanism arranged downstream of the first roller mechanism with respect to the conveying direction includes the second roller in which the second shaft part is inserted. The second roller mechanism also includes the movable holder configured to move in the directions coming close to and being separated from the printing medium by the displacement mechanism, and the second shaft part is provided to the movable holder. Thereby, the second shaft part of the second roller is configured to appropriately move in the directions coming close to and being separated from the printing medium according to a tension and a conveying behavior of the printing medium, so that a so-called aligning function is implemented.

Here, the second roller has the hollow cylindrical shape, and the inner peripheral surface of the hollow cylindrical shape is provided with the concave engaging groove. Meanwhile, the second shaft part that is inserted into the hollow cylindrical shape of the second roller is provided with the protrusion, and the protrusion is engaged with the engaging groove. Thereby, a drive force is transmitted from the second gear positioned at the portion on the first side of the second shaft part to the second shaft part, and the drive force is transmitted to the second roller via the protrusion and the engaging groove.

In this way, according to the present aspect, the drive force is transmitted from the round rod-shaped second shaft part inside the cylindrical shape to the second roller having the cylindrical shape and positioned on the outer periphery-side of the second shaft part.

Thereby, it is possible to improve the entire rigidity, as compared to the related-art structure where a hollow cylindrical drive shaft is rotated on an outer periphery-side of a shaft provided on a movable case, a hollow cylindrical roller is arranged on a further outer periphery-side, and a protrusion on an inner peripheral surface of the roller is engaged with an engaging groove of the drive shaft. Specifically, according to the present aspect, unlike the related-art structure where the drive force is transmitted via the cylindrical drive shaft, the engaging groove, the protrusion, and the cylindrical roller in this order, since the drive force is transmitted via the round rod-shaped second shaft part, the protrusion, the engaging groove, and the cylindrical second roller in this order, distortion is difficult to occur.

Thereby, occurrence of poor conveyance can be reduced even when printing is performed by conveying a printing medium having a large width.

According to another aspect of the present disclosure, there is provided a printing apparatus including a conveying unit, a print head, and a displacement mechanism. The conveying unit is configured to convey a printing medium. The conveying unit includes a first roller mechanism and a second roller mechanism. The second roller mechanism is arranged downstream of the first roller mechanism with respect to a conveying direction. The print head is configured to perform printing on the printing medium being conveyed by the conveying unit. The displacement mechanism is configured to change a positional relationship between the first roller mechanism and the second roller mechanism between a close position at which the first roller mechanism and the second roller mechanism are close to the print head and a separated position at which the first roller mechanism and the second roller mechanism are more distant from the print head than at the close position. The first roller mechanism includes a first shaft part and a first roller. The first shaft part is rotatably supported. The first shaft part is rotatable about a first shaft center extending in a first shaft center direction. The first shaft part has a first gear at a portion on a first side along the first shaft center direction. The first roller is rotatably supported. The first shaft part is inserted in the first roller. The displacement mechanism is configured to cause the first roller and the print head to come close to each other or to be separated from each other. The second roller mechanism includes a movable holder, a second shaft part, a second roller, and a protrusion. The displacement mechanism is configured to cause the movable holder and the printing medium to come close to each other or to be separated from each other. The second shaft part is rotatably supported on the movable holder. The second shaft part is rotatable about a second shaft center extending in a second shaft center direction. The second shaft part has a second gear at a portion on the first side along the second shaft center direction. The second roller has a hollow cylindrical shape. The second shaft part is inserted in the second roller. The second roller is tiltable with respect to the second shaft center of the second shaft part. The second roller has an engaging groove recessed in an inner peripheral surface of an intermediate part of the second roller in the second shaft center direction. The protrusion protrudes from an outer peripheral surface of the second shaft part and is engaged with the engaging groove of the second roller.

BRIEF DESCRIPTION OF DRAWINGS

FIG. 4A is a front view of main parts in a lever-laid down state, and FIG. 4B is a front view of main parts in a lever-erected state;

FIG. 5A is a side view of main parts in the lever-laid down state, and FIG. 5B is a side view of main parts in the lever-erected state;

FIGS. 8A and 8B show main parts of the second roller mechanism, in which FIG. 8A is a front view of the second roller mechanism and FIG. 8B is a partially broken side view of the second roller mechanism;

DESCRIPTION OF EMBODIMENTS

Hereinafter, a printing apparatus according to an embodiment of the present disclosure will be described with reference to the drawings. Note that, the constitutional elements of the embodiment shown in the respective drawings are appropriately changed in scale so as to facilitate the understanding of the present disclosure. In descriptions below, the printing apparatus is defined to be in a use state when printing is executed by inputting characters and the like, for example, when the printing apparatus is placed on a table or the like and printing is executed, and the upper, lower, left and right directions as seen from a user side when the printing apparatus in the use state will be used for describing the directions.

In the present embodiment, a printing apparatus which performs printing on a printing medium in a state where a tape cassette configured to accommodate the printing medium is detachably mounted thereon is exemplified.

Figure 1:
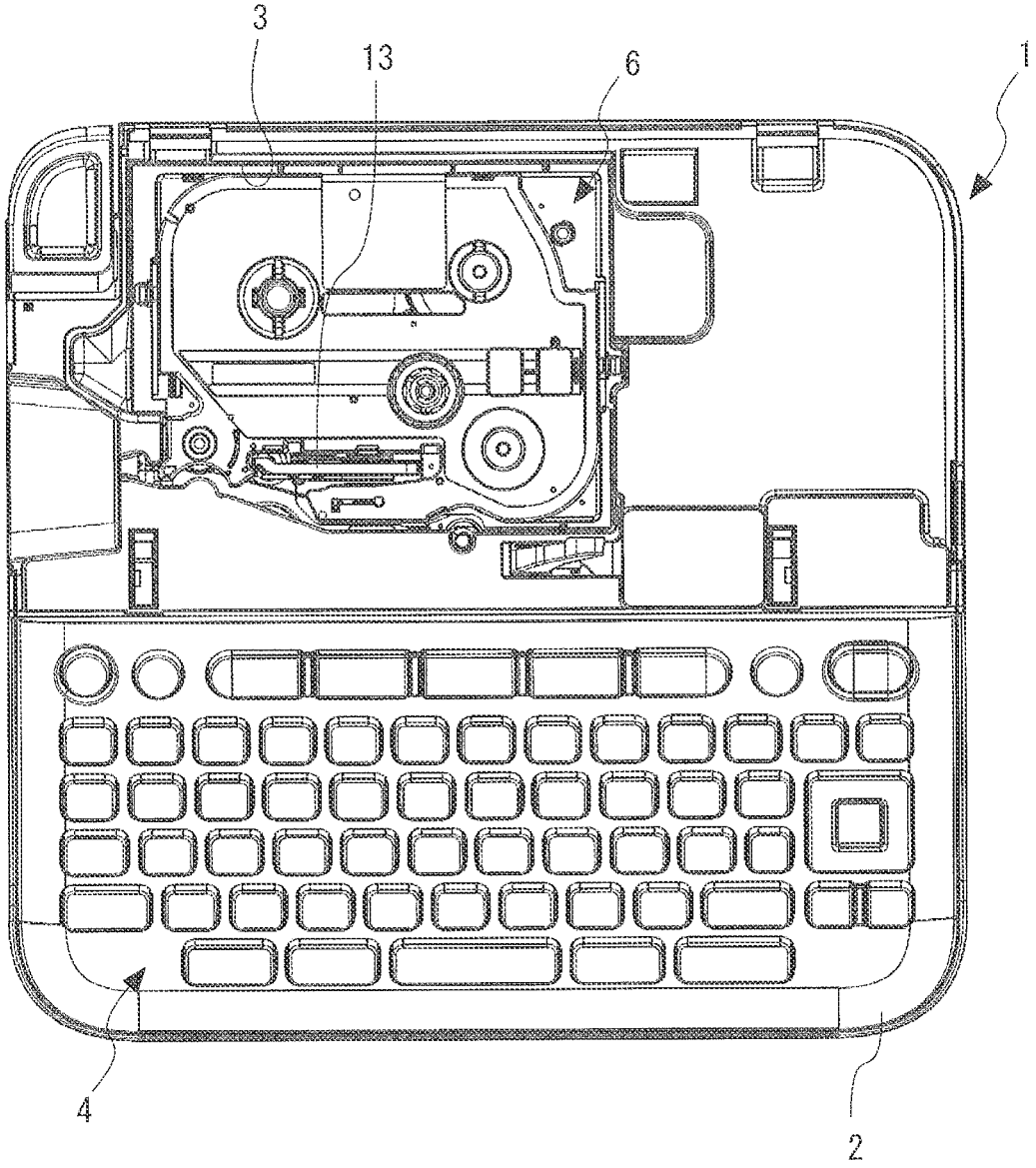
FIG. 1 is a front view of a printing apparatus in a state where a cover is removed.

As shown in FIG. 1, a printing apparatus 1 includes a cassette accommodation unit 3 for mounting a tape cassette, which will be described later, and a keyboard unit 4 for inputting characters and the like on an upper surface of a body case 2 having a housing shape.

Note that, the cassette accommodation unit 3 is configured to be covered by a cover (not shown). The cover is an openable type cover configured to rotate via a hinge mechanism with respect to the body case 2. On the cover (not shown), for example, a display unit for displaying characters and the like input using the keyboard unit 4 by a user is arranged.

Figure 2:
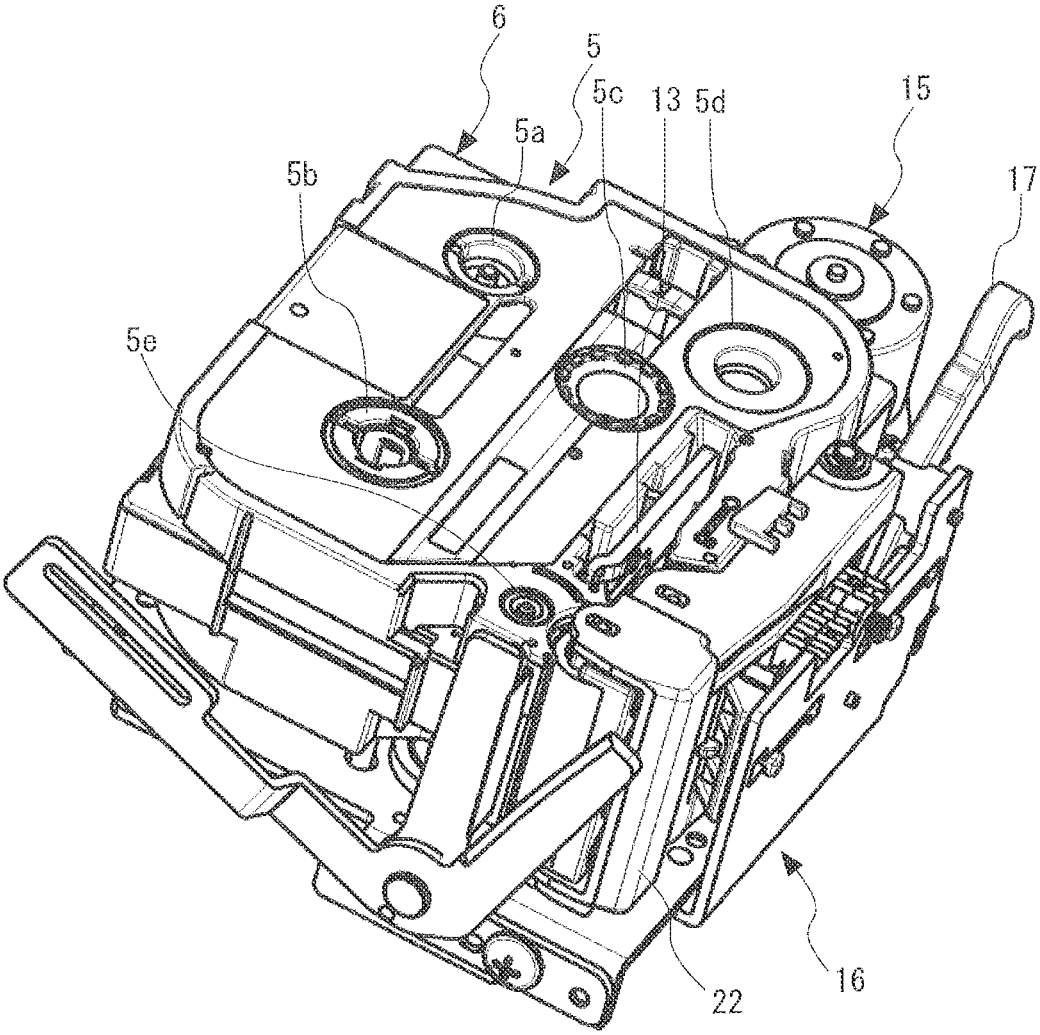
FIG. 2 is a perspective view of a structure around a tape cassette.

As shown in FIG. 2, the tape cassette 5 that is used for the printing apparatus 1 can be mounted to a printing conveying unit 6 arranged in the cassette accommodation unit 3.

The tape cassette 5 includes a first roll 5*b* on which a band-shaped base material tape (not shown) is wound, a second roll 5*a* on which a clear cover tape (not shown) is wound, a ribbon supply-side roll 5*d* on which an ink ribbon (not shown) is wound, a ribbon winding roller 5*c* configured to wind the ink ribbon after printing, and a tape conveying roller 5*e*. Note that, the base material tape is a double-sided tape where a release paper adheres to one surface and an adhesive layer is provided on the other surface, and a desired label is prepared by being bonded with a printed cover tape. In descriptions below, the cover tape is collectively referred to as a printing medium unless otherwise specified.

Figure 3:
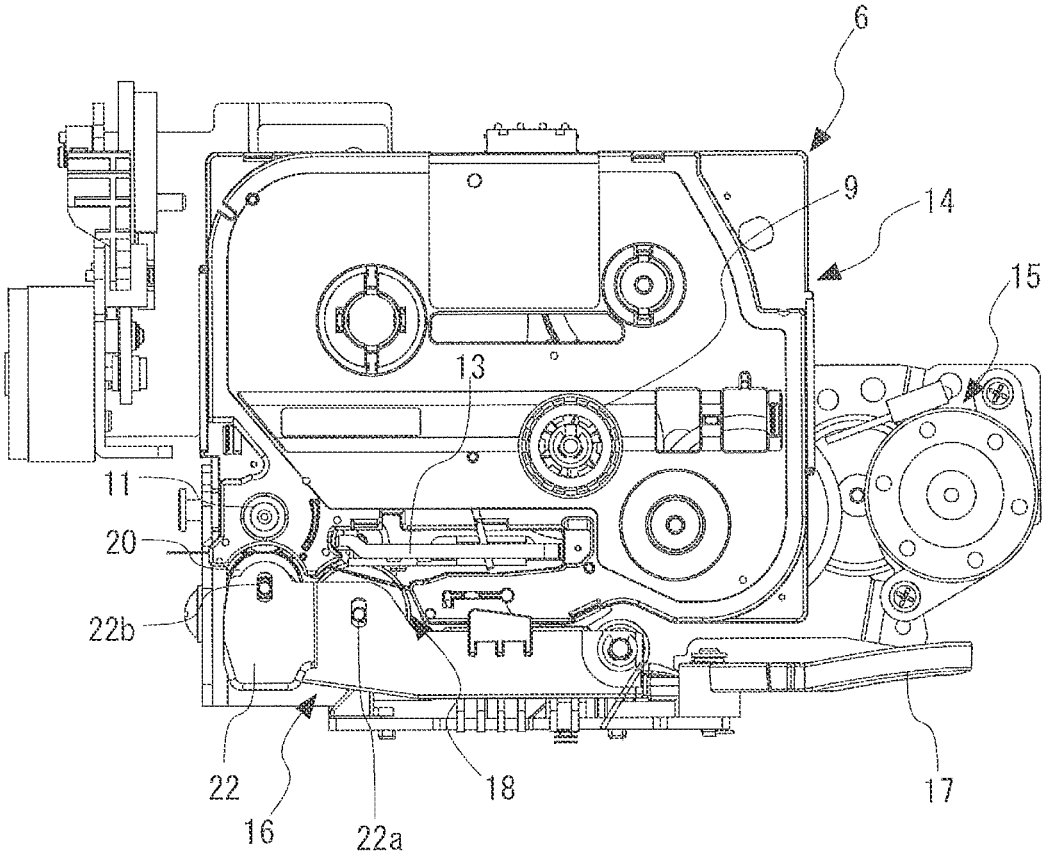
FIG. 3 is a front view of a printing conveying unit.

As shown in FIG. 3, the printing conveying unit 6 includes a first conveying part 14 and a second conveying part 16. The first conveying part 14 includes a reel unit 9 configured to rotationally drive the ribbon winding roller 5*c* and a drive roller 11 configured to rotationally drive the tape conveying roller 5*e* by drive of a drive motor 15, and a print head unit 13 including a print head. Although described later in detail, the second conveying part 16 includes a platen roller 18 configured to perform printing on the cover tape while superimposing, pressing and conveying the ink ribbon and the cover tape to the print head unit 13, and a sub-roller 20 configured to sandwich, bond and convey the cover tape and the base material tape between the sub-roller 20 and the tape conveying roller 5*e*.

Figure 4A:
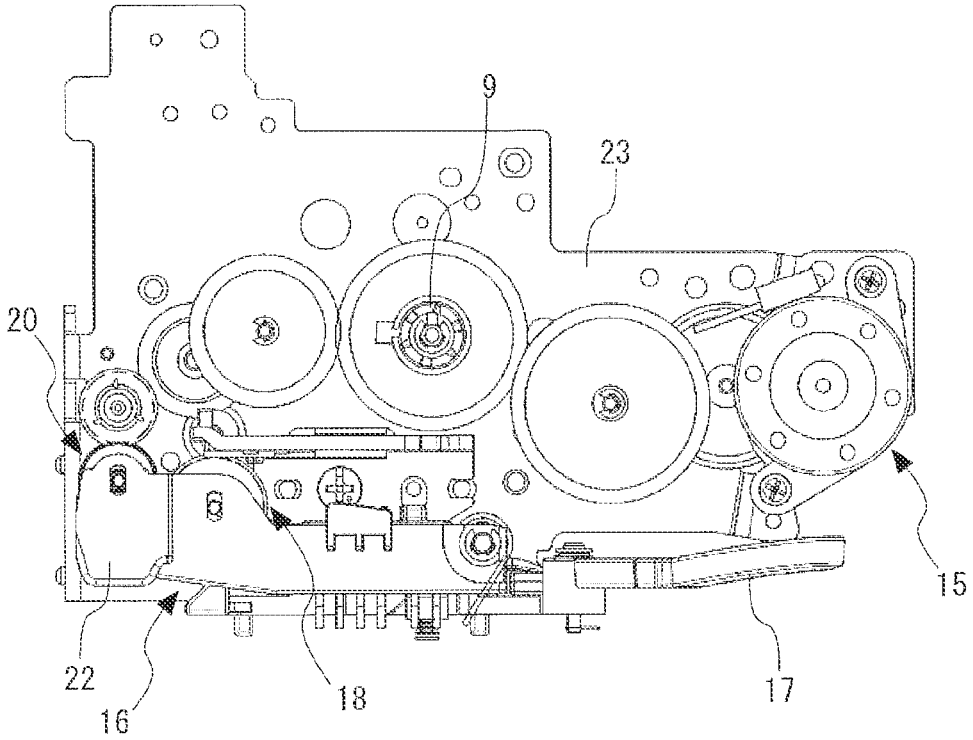
FIGS. 4A and 4B show an operation of a second roller mechanism configured to operate in conjunction with a lever, where
Figure 4B:
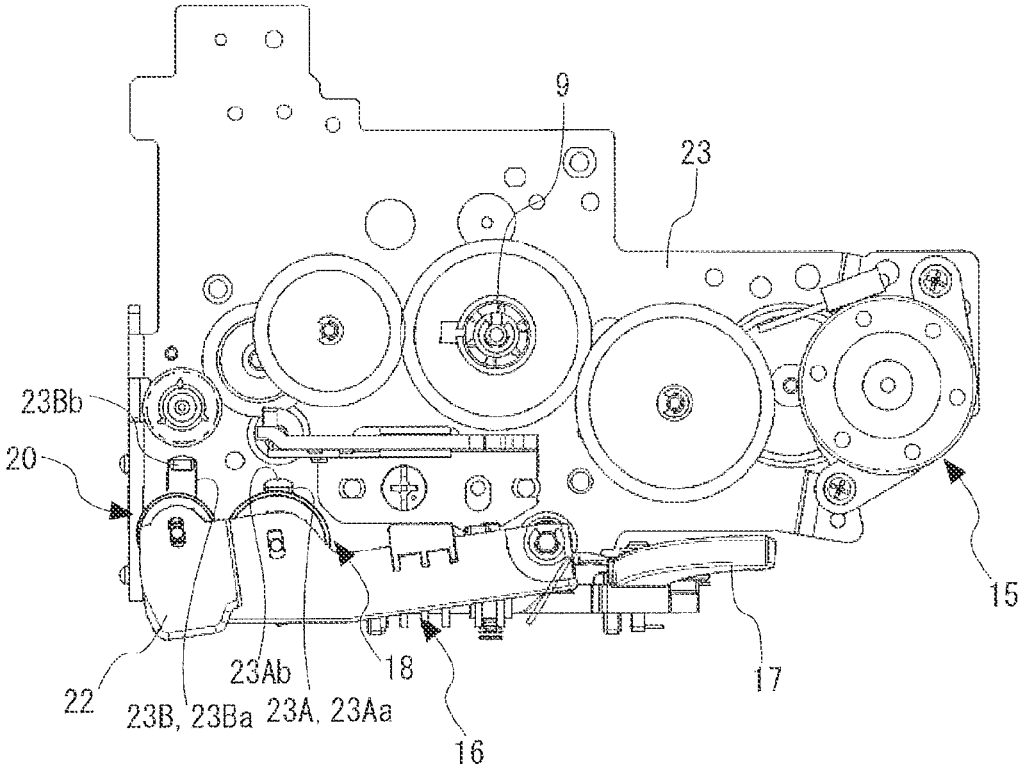
Figure 5A:
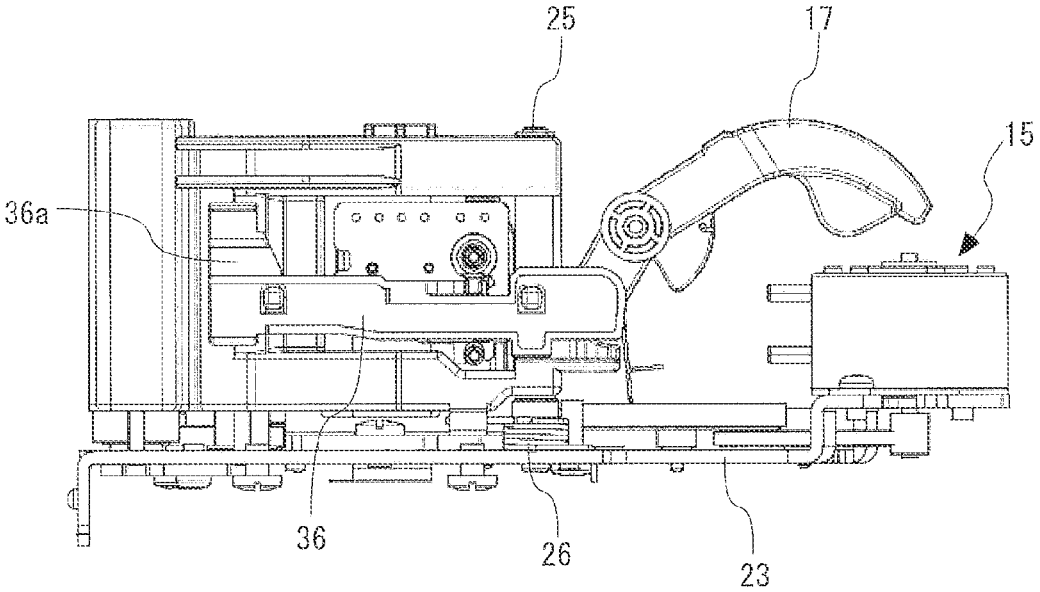
FIGS. 5A and 5B show an operation of the second roller mechanism configured to operate in conjunction with the lever, where
Figure 5B:
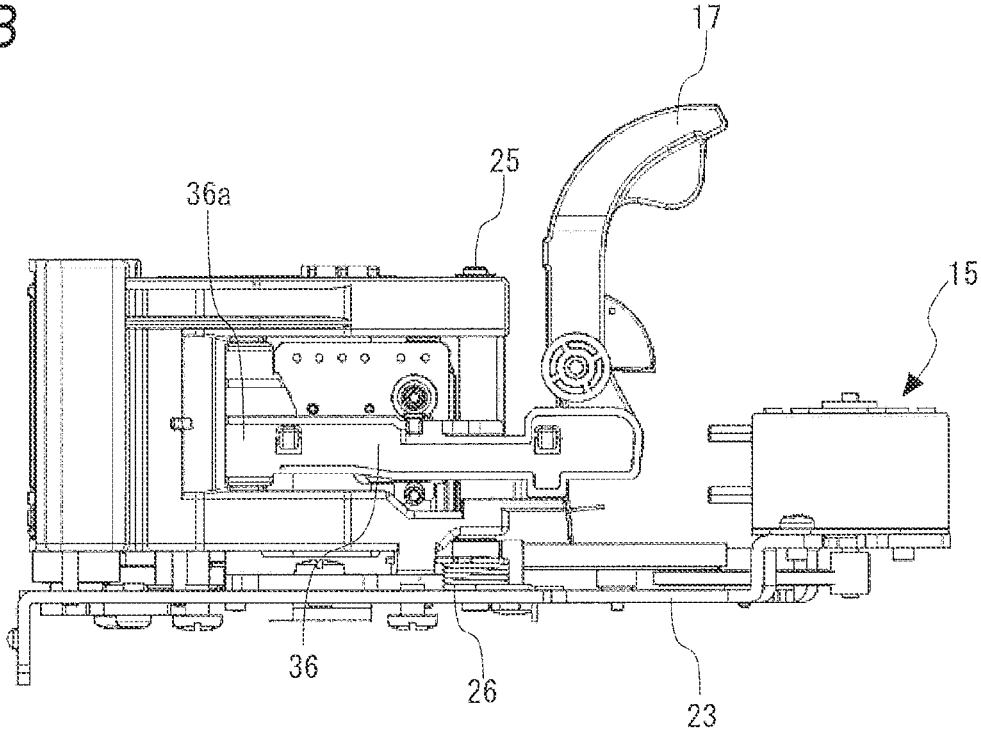

The second conveying part 16 includes a lever 17 that is pushed and rotated to a laid-down side by the cover when the cassette accommodation unit 3 is closed by the cover, as shown in FIGS. 4A and 5A, and is rotated to an erected side when the cassette accommodation unit 3 is opened by the cover, as shown in FIGS. 4B and 5B.

The second conveying part 16 constitutes a conveying unit for conveying the printing medium, and as shown in FIGS. 6 to 10, includes a first roller mechanism 19 having the platen roller 18 as a first roller, and a second roller mechanism 21 having the sub-roller 20 as a second roller and arranged downstream of the first roller mechanism 19 with respect to the conveying direction.

The second conveying part 16 includes a roller holder 22 that constitutes a displacement mechanism of a head moving mechanism, which is configured to displace the first roller mechanism 19 and the second roller mechanism 21 to a close position and a separated position with respect to the print head unit 13, in conjunction with rotation of the lever 17.

Note that, the drive motor 15, and the lever 17 and the roller holder 22 constituting the displacement mechanism are mounted to the body case 2 via a base frame 23 and a side frame 24. In addition, the lever 17 is urged in a cover opening direction by a spring 26 mounted to the roller holder 22 via a shaft 25.

The first roller mechanism 19 has a first shaft part 28 rotatably supported on the roller holder 22 and having a first gear 27 at a portion on a first side (a lower side, in this example) along a shaft center direction. The platen roller 18 is rotatably supported on the roller holder 22 via the first shaft part 28. When the roller holder 22 swings in conjunction with rotation of the lever 17, the platen roller 18 moves in directions coming close to and being separated from the print head unit 13.

The second roller mechanism 21 includes a movable holder 29 configured to move in directions coming close to and being separated from the printing medium by the displacement mechanism, a second shaft part 30 held by a first receiving part 29*a* on a first side of the movable holder 29 along a shaft center direction and a second receiving part 29*b* on a second side (an upper side, in this example) of the movable holder 29 opposite to the first side along the shaft center direction, and a second gear 31 arranged on a side closer to the second side than the first receiving part 29*a* of the movable holder 29 and rotatably supported by the second shaft part 30.

The sub-roller 20 has a hollow cylindrical shape and is supported to be rotatable with respect to the second shaft part 30 and to be tiltable with respect to the shaft center of the second shaft part 30 between the second receiving part 29*b* of the movable holder 29 and the second gear 31. Here, the sub-roller 20 has, for example, a double structure of an outer tube body 20*a* made of soft resin or the like and an inner tube body 20*b* made of rigid resin or the like. The second shaft part 30 is inserted in the inner tube body 20*b*, and an inner peripheral surface of an intermediate part of the inner tube body 20*b* in the shaft center direction is in contact with the second shaft part 30. Note that, 'soft' and 'rigid' mean hardness when the outer side and the inner side are compared, and do not mean hardness chemically classified as a resin material.

The inner peripheral surface of the intermediate part of the inner tube body 20*b* in the shaft center direction is formed with concave engaging grooves 20*c*. In the present embodiment, the engaging grooves 20*c* are formed from the first side to a middle portion of the inner tube body 20*b*, and are formed in a pair so as to face each other.

Note that, the second shaft part 30 is provided with a shaft-shaped protrusion 34 extending in a direction orthogonal to the axis line of the second shaft part 30 and protruding from an outer peripheral surface of the second shaft part 30, and both ends of the protrusion 34 protruding from the outer peripheral surface of the second shaft part 30 are engaged with the engaging grooves 20*c* of the sub-roller 20. Therefore, the second shaft part 30 adopts a configuration where only the protrusion 34 is in contact with the inner tube body 20*b*.

Note that, the roller holder 22 is formed with long holes 22*a* and 22*b* so as to allow displacement of the first shaft part 28 and the second shaft part 30 with respect to the displacement direction of the roller holder 22.

On the base frame 23, each of gears G1 to G7, which include a transmission gear G6 as a third gear meshed with the first gear 27 and a transmission gear G7 as a fourth gear meshed with the second gear 31, are rotatably supported. In addition, as shown in FIG. 4B, the base frame 23 is formed with a first through-hole 23A through which a portion of the first shaft part 28 on the first side penetrates and a second through-hole 23B through which a portion of the second shaft part 30 on the first side penetrates. The first shaft part 28 penetrates through the first through-hole 23A so as to be movable in a direction orthogonal to a penetration direction thereof and the second shaft part 30 penetrates through the second through-hole 23B so as to be movable in a direction orthogonal to the penetration direction thereof. When the roller holder 22 is located in a retreat position, the first shaft part 28 is not in contact with a first edge portion 23Aa of the first through-hole 23A and the second shaft part 30 is not in contact with a second edge portion 23Ba of the second through-hole 23B, and when the roller holder 22 is located in a print position, the first shaft part 28 is in contact with a first positioning portion 23Ab provided at the first edge portion 23Aa and the second shaft part 30 is in contact with a second positioning portion 23Bb provided at the second edge portion 23Ba.

Thereby, when the roller holder 22 is located in the print position, the first shaft part 28 can be positioned to a predetermined position of the first edge portion 23Aa and the second shaft part 30 can be positioned to a predetermined position of the second edge portion 23Ba. As a result, distances between the gears meshed with each other, i.e., between the first gear 27 and the third gear and between the second gear 31 and the fourth gear can be kept constant. Accordingly, it is possible to suppress variation in backlash of the gears and to improve conveying accuracy.

The displacement mechanism includes the roller holder 22 configured to swing and move the first roller mechanism 19 and the second roller mechanism 21 in the directions coming close to and being separated from the print head unit 13. The first roller mechanism 19 is provided to the roller holder 22. The platen roller 18 is rotatably supported on the roller holder 22 and moves in the directions coming close to and being separated from the print head unit 13 by swinging of the roller holder 22. The second roller mechanism 21 is arranged on a further downstream side of the roller holder 22 than the first roller mechanism 19 with respect to the conveying direction. The movable holder 29 is supported on the roller holder 22 and is configured to move in the directions coming close to and being separated from the printing medium.

In this way, the first roller mechanism 19 and the second roller mechanism 21 are provided to the roller holder 22 configured to swing. Thereby, the swinging of the roller holder 22 can move the platen roller 18 of the first roller mechanism 19 in the directions coming close to and being separated from the print head unit 13 and move the movable holder 29 of the second roller mechanism 21 in the directions coming close to and being separated from the printing medium.

Here, the second shaft part 30 of the sub-roller 20 is made of metal. The protrusion 34 functions as a first pin (metal or non-metal) extending in the direction orthogonal to the shaft center of the second shaft part 30. The engaging grooves 20*c* of the sub-roller 20 are engaged with the protrusion 34 as a first pin, and the rotation of the second shaft part 30 is transmitted to the sub-roller 20 via the protrusion 34 and the engaging grooves 20*c* engaged with each other.

In this way, the protrusion 34 as a first pin provided on the second shaft part 30 made of metal is engaged with the engaging grooves 20*c* of the sub-roller 20, so that the rotation of the second shaft part 30 is transmitted via the second shaft part 30, the protrusion 34, the engaging grooves 20*c*, and the sub-roller 20 in this order. In this way, since the drive force is transmitted from the round rod-shaped second shaft part 30 to the hollow cylindrical sub-roller 20 positioned on the outer periphery-side of the second shaft part 30, the rigidity can be increased, as compared to a related-art structure where the drive force is transmitted from a hollow cylindrical drive shaft to the hollow cylindrical sub-roller 20.

Here, the second roller mechanism 21 further has a second pin 35 protruding from the outer peripheral surface of the second shaft part 30 and extending in a direction orthogonal to the shaft center of the second shaft part 30, and the second gear 31 is fitted with the second pin 35, so that the rotation of the second gear 31 is transmitted to the second shaft part 30 via the second pin 35 fitted to the second gear. In this case, the extension direction of the protrusion 34 and the extension direction of the second pin 35 are the same.

In this way, the second pin 35 provided to protrude from the second shaft part 30 is fitted to the second gear 31, so that the rotation of the second gear 31 is transmitted to the second shaft part 30 via the second pin 35. Thereby, the rotation of the second gear 31 can be transmitted to the second shaft part 30 by the highly rigid structure.

An end face on the first side of the sub-roller 20 in the shaft center direction and an end face on the second side opposite to the first side of the second gear 31 in the shaft center direction are spaced from each other in the shaft center direction.

Thereby, the sub-roller 20 and the second gear 31 can be arranged with being spaced in the shaft center direction, so that it is possible to implement a structure different from the related-art structure where the drive force is transmitted from the hollow cylindrical drive shaft to the hollow cylindrical sub-roller 20.

Here, a moving body 36 configured to swing the roller holder 22 between the retreat position and the print position by moving between a first position and a second position is further provided. The moving body 36 has a support part 36*a* in contact with a surface of the roller holder 22 on an opposite side to a side on which the platen roller 18 is arranged, and holds the roller holder 22 so as not to be inclined. A length of the support part 36*a* in the shaft center direction (a length in an upper and lower direction of the drawing sheet of FIG. 5A) is greater than ½ of a length of the roller holder 22 in the shaft center direction.

Specifically, when the moving body 36 moves from the first position to the second position, the roller holder 22 swings between the retreat position and the print position. At this time, the moving body 36 is provided with the support part 36*a* whose length in the shaft center direction is greater than half of the length of the roller holder 22 in the shaft center direction. The support part 36*a* is brought into contact with the side of the roller holder 22 opposite to the platen roller 18, thereby holding the roller holder 22 so as not to be inclined. Thereby, it is possible to suppress the roller holder 22 from falling down or inclining due to a reactive force generated at a time when the platen roller 18 is brought into contact with the print head unit 13.

Like this, the displacement mechanism includes the roller holder 22 configured to move the first roller mechanism 19 and the second roller mechanism 21 in the directions coming close to and being separated from the print head unit 13 by swinging in conjunction with rotation of the lever. The first roller mechanism 19 is provided to the roller holder 22. The platen roller 18 is rotatably supported by the roller holder 22, and is configured to be moved in the directions coming close to and being separated from the print head unit 13 by swinging of the roller holder 22. The second roller mechanism 21 is arranged on a portion of the roller holder 22 on a further downstream side than the first roller mechanism 19 with respect to the conveying direction. The movable holder 29 is supported by the roller holder and is configured to move in the directions coming close to and being separated from the printing medium.

Specifically, the first roller mechanism 19 and the second roller mechanism 21 are provided to the roller holder 22 configured to swing. Thereby, the swinging of the roller holder 22 can move the platen roller 18 of the first roller mechanism 19 in the directions coming close to and being separated from the print head unit 13 and move the movable holder 29 of the second roller mechanism 21 in the directions coming close to and being separated from the printing medium.

Here, the second roller mechanism 21 has a plurality of compression springs 33 as an urging member arranged between the roller holder 22 and the movable holder 29 and configured to urge the movable holder 29 toward the printing medium.

Therefore, the sub-roller 20 is urged in a direction of bringing the movable holder 29 close to the printing medium by the compression springs 33 provided between the roller holder 22 and the movable holder 29. Thereby, for example, even when the tension or conveying behavior of the printing medium changes, the movable holder 29 urged toward the printing medium in accordance thereto and can be thus moved in the directions coming close to and being separated from the printing medium, so that a smooth aligning function can be implemented.

Here, the urging member can also be configured such that a first pressing force for pressing the roller holder 22 on the first side is greater than a second pressing force for pressing the roller holder 22 on the second side opposite to the first side.

In this case, the urging member is configured so that the pressing force on the first side close to the second gear 31 is greater than the pressing force on the second side. Thereby, it is possible to prevent the second gear 31 from moving away from a gear to which the second gear 31 meshes.

Figure 6:
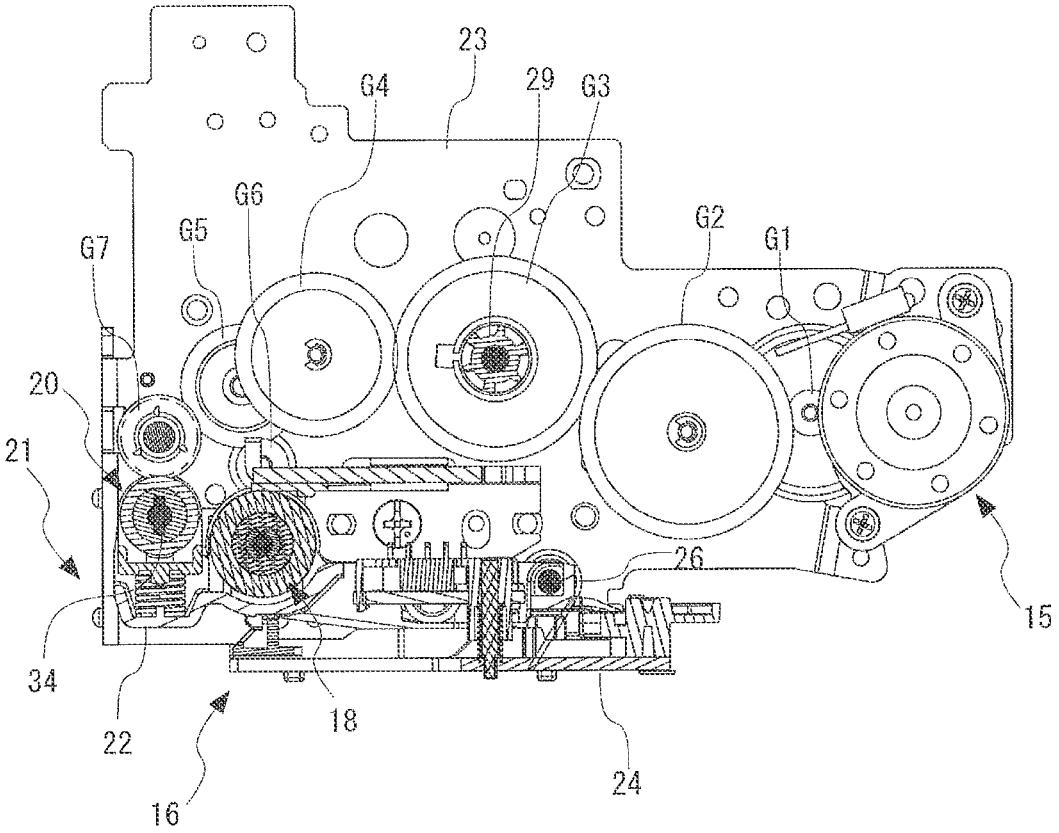
FIG. 6 is a partially broken front view of the second roller mechanism.
Figure 7:
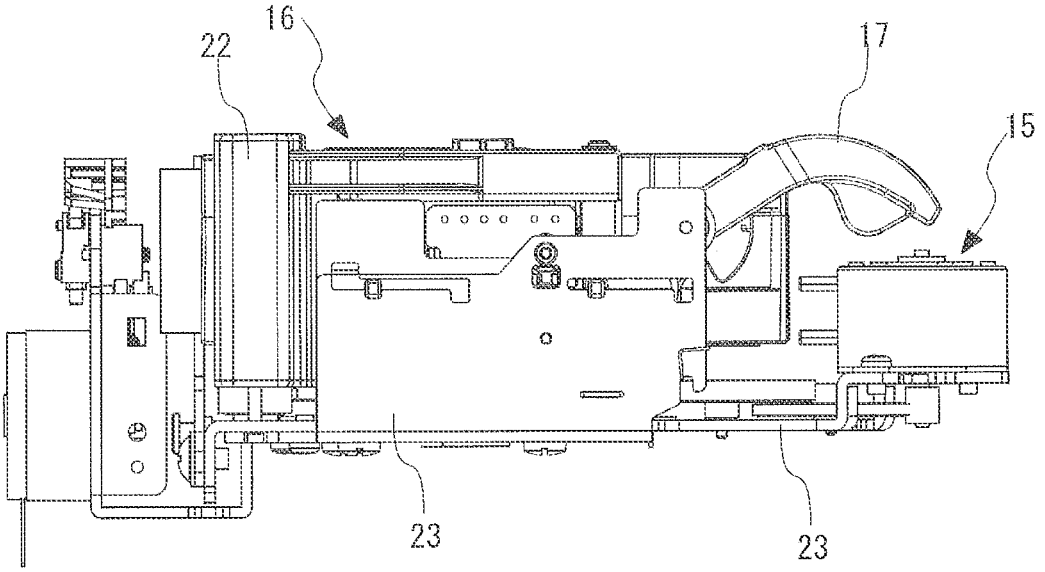
FIG. 7 is a side view of the second roller mechanism.
Figure 8A:
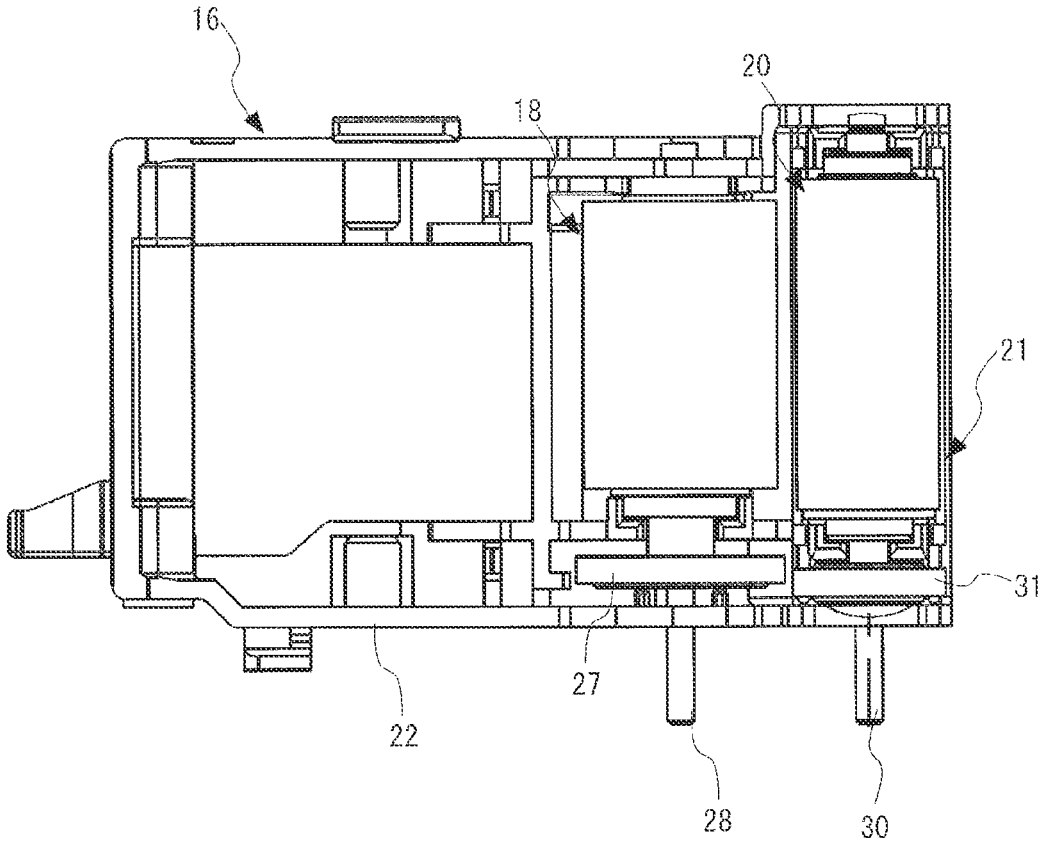
Figure 8B:
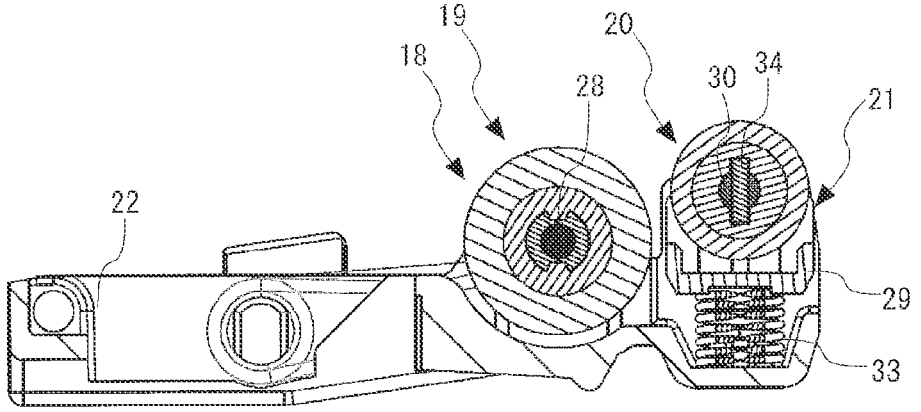
Figure 9:
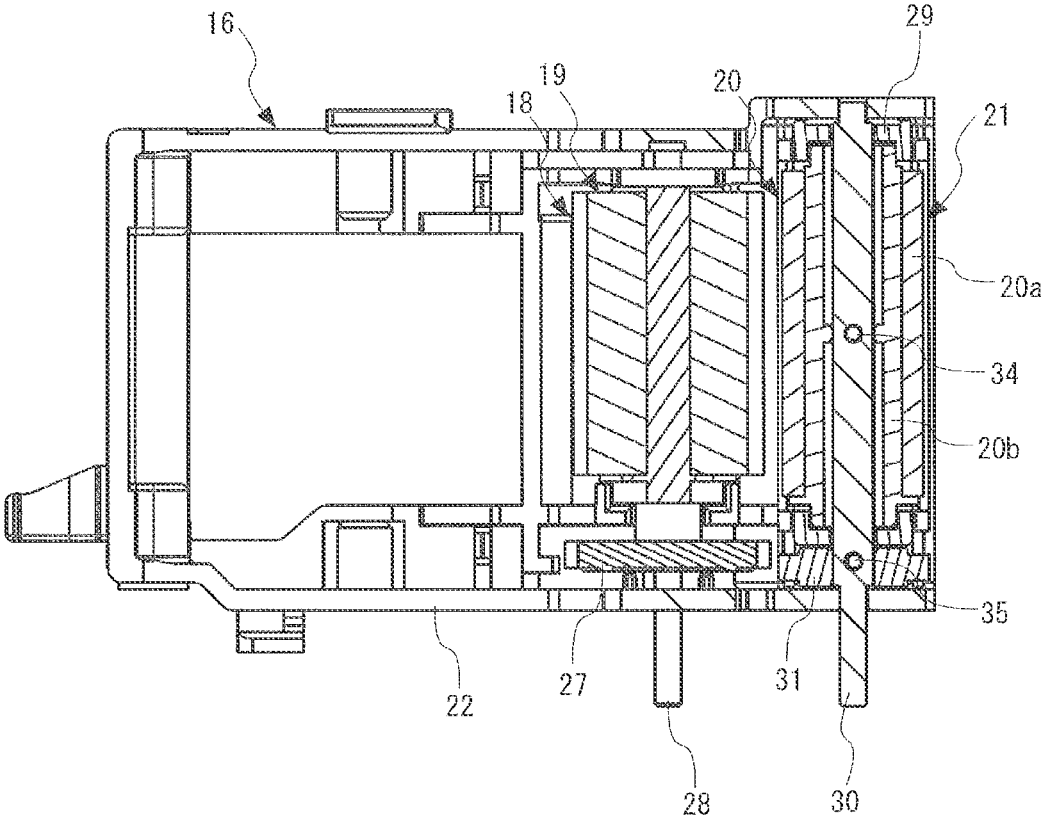
FIG. 9 is a partially broken front view of the second roller mechanism.
Figure 10:
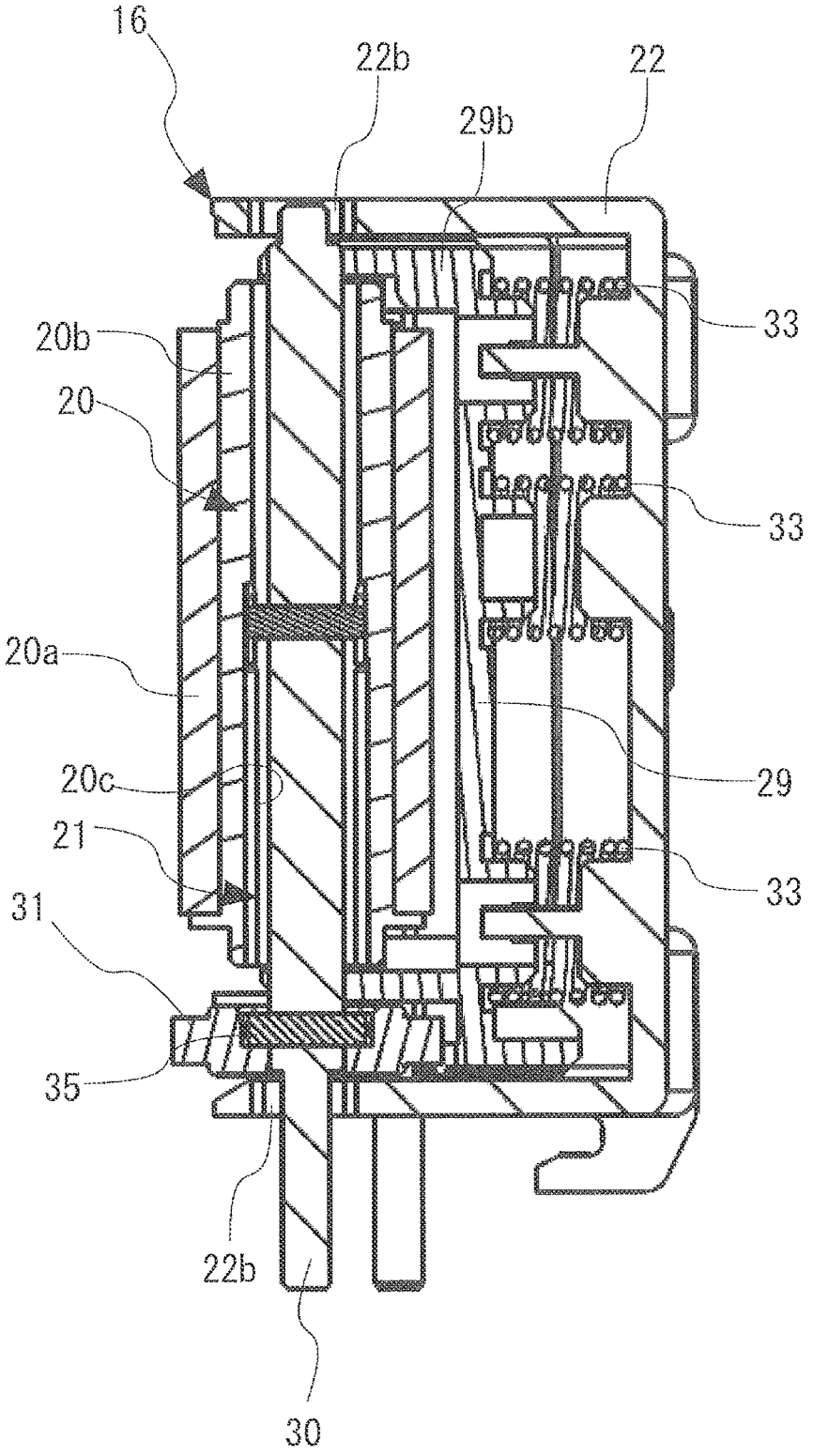
FIG. 10 is a cross-sectional view of main parts of the second roller mechanism.

As shown in FIG. 6, the plurality of transmission gears G1 to G7 having different diameters and configured to transmit drive of the drive motor 15 is arranged on the base frame 23. Rotation of the transmission gear G4 rotates the reel unit 9 and rotation of the transmission gear G5 rotates the transmission gear G6 and the transmission gear G7.

In the above-described basic configuration, when the cover is opened to accommodate the tape cassette 5 in the cassette accommodation unit 3 and the cover is closed to close the cassette accommodation unit 3, the erected lever 17 is pushed and rotated to the laid-down side.

When the lever 17 is rotated to the laid-down side, the roller holder 22 is displaced toward the print head unit 13 in accordance thereto and the transmission gear G6 and the transmission gear G7 are rotated by drive of the drive motor 15.

When the transmission gear G6 is rotated, the platen roller 18 is rotated via the first gear 27 meshed with the transmission gear G6. When the transmission gear G7 is rotated, the drive roller 11 is rotated and the sub-roller 20 is rotated via the second gear 31 meshed with the transmission gear G7.

Since the base material tape and the cover tape are superimposed and sandwiched between the drive roller 11 and the sub-roller 20, when the drive roller 11 and the sub-roller 20 are rotated, the base material tape and the cover tape are bonded and conveyed.

At this time, according to the above-described reinforcement structure of the sub-roller 20, occurrence of poor conveyance can be reduced even when printing is performed by conveying a printing medium having a large width.

As described above, the printing apparatus 1 includes the conveying unit configured to convey the printing medium, the conveying unit including the first roller mechanism and the second roller mechanism 21, and the second roller mechanism 21 being arranged downstream of the first roller mechanism 19 with respect to the conveying direction; the print head unit 13 configured to perform printing on the printing medium being conveyed by the conveying unit; and the displacement mechanism (the lever 17 and the roller holder 22) configured to displace the first roller mechanism 19 and second roller mechanism 21 to a close position at which the first roller mechanism 19 and the second roller mechanism 21 are close to the print head unit 13 and to a separated position at which the first roller mechanism 19 and the second roller mechanism 21 are more distant from the print head unit 13 than at the close position, in which the first roller mechanism 19 includes: the first shaft part 28 which is rotatably supported, the first shaft part 28 being rotatable about a first shaft center extending in a first shaft center direction, and the first shaft part 28 having the first gear 27 at a portion on the first side along the first shaft center direction; and the platen roller 18 which is rotatably supported, the first shaft part 28 being inserted in the platen roller 18, and the platen roller 18 being configured to be moved in the directions coming close to and being separated from the print head unit 13 by the displacement mechanism, and the second roller mechanism 21 includes: the roller holder 22 configured to be moved in the directions coming close to and being separated from the printing medium by the displacement mechanism; the second shaft part 30 which is rotatably supported on the roller holder 22, the second shaft part 30 being rotatable about a second shaft center extending in a second shaft center direction, and the second shaft part 30 having the second gear 31 at a portion on the first side along the second shaft center direction; the sub-roller 20 having a hollow cylindrical shape, second shaft part 30 being inserted in the sub-roller 20, the sub-roller 20 being tiltable with respect to the second shaft center of the second shaft part 30, and the sub-roller having the engaging groove 20*c* recessed in the inner peripheral surface of the intermediate part of the sub-roller 20 in the second shaft center direction; and the protrusion 34 protruding from the outer peripheral surface of the second shaft part 30 and engaged with the engaging groove 20*c* of the sub-roller 20.

As described above, the printing apparatus 1 includes the first roller mechanism 19 and the second roller mechanism 21 along the conveying path of the conveying unit. The first roller mechanism 19 includes the platen roller 18 in which the first shaft part 28 is inserted. The second roller mechanism 21 arranged downstream of the first roller mechanism 19 with respect to the conveying direction includes the sub-roller 20 in which the second shaft part 30 is inserted. The second roller mechanism 21 also includes the roller holder 22 configured to move in the directions coming close to and being separated from the printing medium by the displacement mechanism. The second shaft part 30 is provided to the roller holder 22. Thereby, the second shaft part 30 of the sub-roller 20 is configured to appropriately move in the directions coming close to and being separated from the printing medium according to the tension and the conveying behavior of the printing medium, so that the so-called aligning function is implemented.

Here, the sub-roller 20 has the hollow cylindrical shape, and the inner peripheral surface of the hollow cylindrical shape is provided with the concave engaging groove 20*c*. Meanwhile, the second shaft part 30 that is inserted in the hollow cylindrical sub-roller 20 is provided with the protrusion 34, and the protrusion 34 is engaged with the engaging groove 20*c*. Thereby, the drive force is transmitted from the second gear 31 positioned at the portion on the first side of the second shaft part 30 to the second shaft part 30, and the drive force is transmitted to the sub-roller 20 via the protrusion 34 and the engaging groove 20*c*.

In this way, the drive force of the drive motor 15 is transmitted from the round rod-shaped second shaft part 30 inside the cylindrical shape to the sub-roller 20 having the cylindrical shape and positioned on the outer periphery-side of the second shaft part 30.

Thereby, it is possible to improve the entire rigidity, as compared to a related-art structure where a hollow cylindrical drive shaft is rotated on an outer periphery-side of a shaft provided on a movable case, a hollow cylindrical roller is arranged on a further outer periphery-side, and a protrusion on an inner peripheral surface of the roller is engaged with an engaging groove of the drive shaft. Specifically, unlike the related-art structure where the drive force is transmitted via the cylindrical drive shaft, the engaging grooves 20*c*, the protrusion 34, and the cylindrical roller in this order, since the drive force is transmitted via the round rod-shaped second shaft part 30, the protrusion 34, the engaging grooves 20*c*, and the cylindrical sub-roller 20 in this order, the distortion is difficult to occur. Thereby, occurrence of poor conveyance can be reduced even when printing is performed by conveying a printing medium having a large width.

Figure 11:
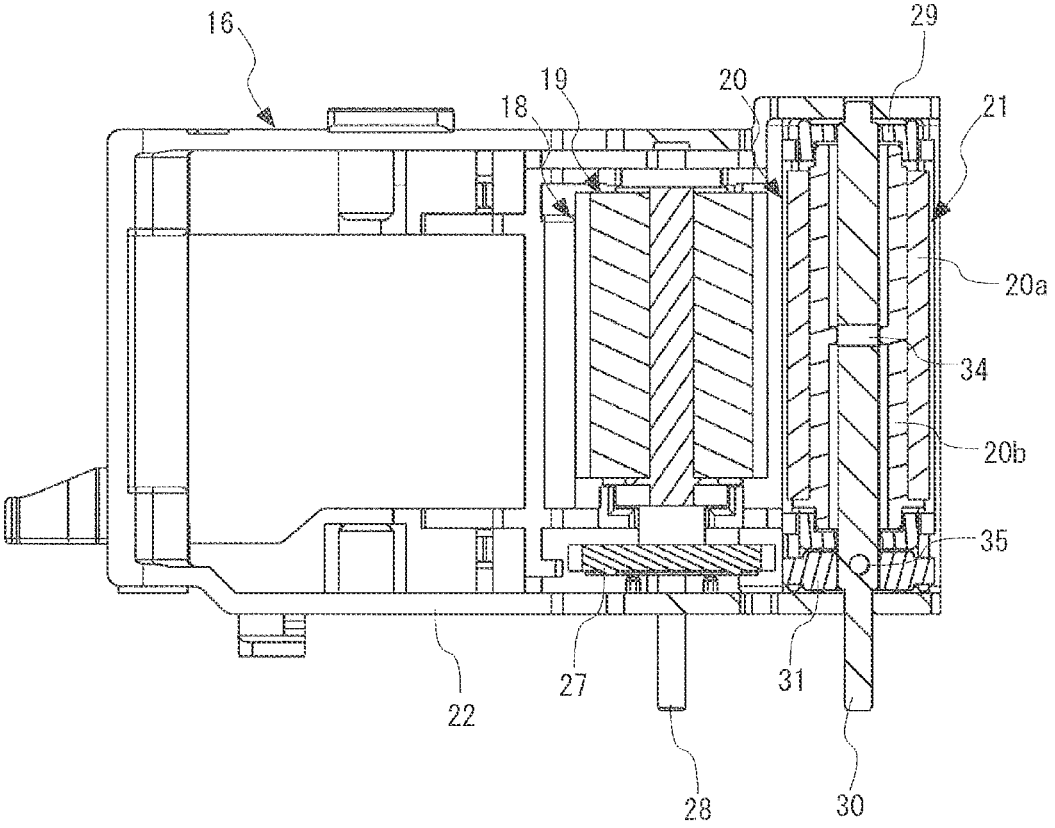
FIG. 11 is a partially broken front view of another second roller mechanism.
Figure 12:
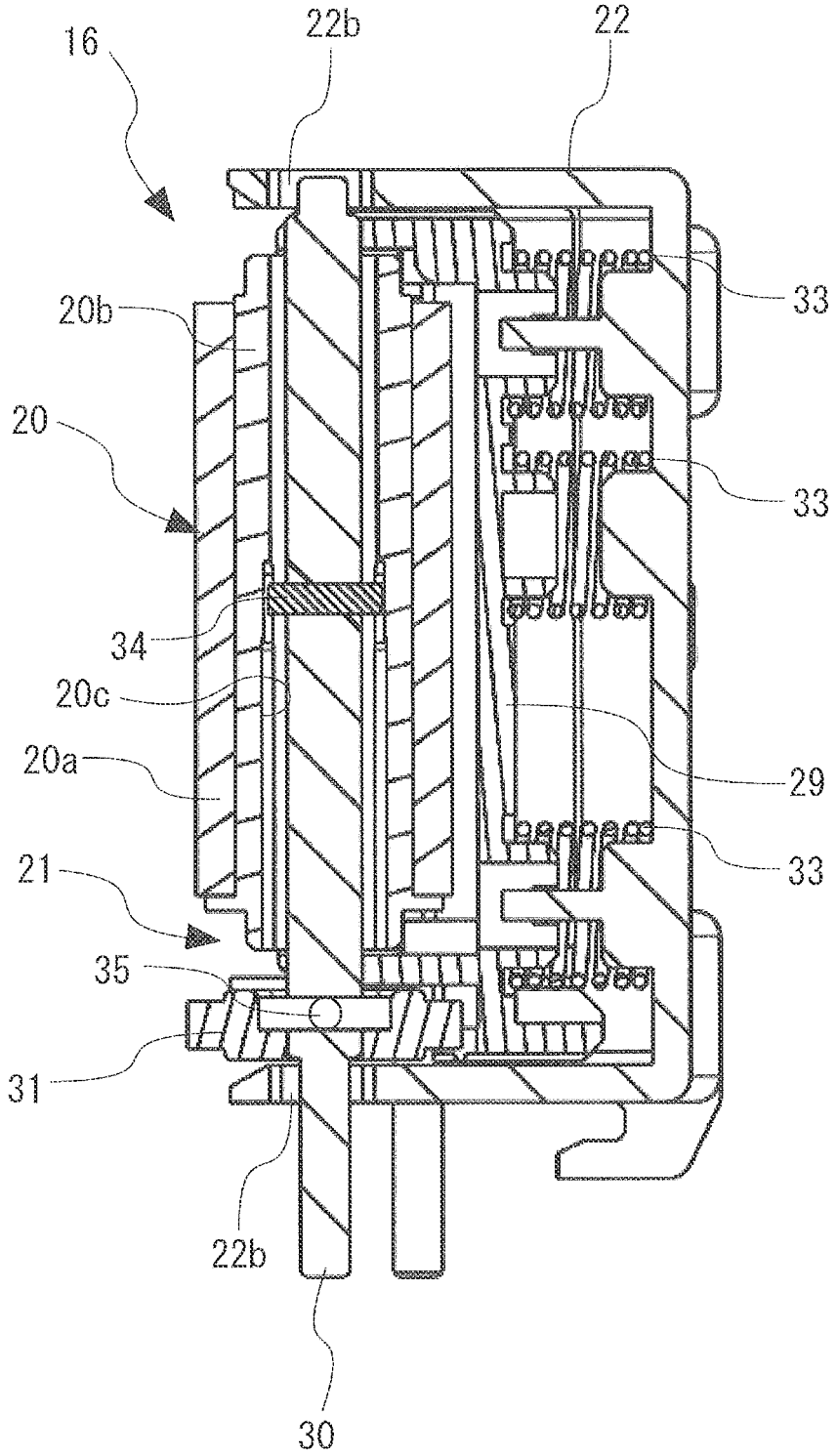
FIG. 12 is a cross-sectional view of main parts of the other second roller mechanism.

Here, as shown in FIGS. 11 and 12, the extension direction of the protrusion 34 of the second shaft part 30 and the extension direction of the second pin 35 of the second shaft part 30 may be arranged with a phase difference of approximately 90°.

In this case, the protrusion 34 and the second pin 35 are arranged with a phase difference of approximately 90°, so that during the transmission of rotation along the above-described order, the effect of backlash on the engagement between the protrusion 34 and the sub-roller 20 and the effect of backlash on the fitting between the second pin 35 and the second gear 31 do not occur at the same time and occur at different timings. Therefore, it is possible to reduce the effects of both the backlashes on the entire second roller mechanism 21.

In addition, when manufacturing components, since press-fitting of the protrusion 34 to the second shaft part 30 and press-fitting of the second pin 35 to the second shaft part 30 can be performed in separate processes, the workability during processing can be improved.

In the above, the embodiment of the present disclosure has been described in detail with reference to the accompanying drawings. However, the scope of the technical spirit of the present disclosure is not limited to the above embodiment. It is obvious to one skilled in the art that a variety of changes, modifications, combinations and the like can be made within the scope of the technical spirit of the present disclosure defined in the claims. Therefore, the technology of the changes, modifications, combinations and the like is also included within the scope of the technical spirit of the present disclosure.

Further, the tape cassette 5 is a type that the cover tape on which printing has been performed adheres to the base material tape. However, the present disclosure is not limited thereto. For example, the present disclosure can also be applied to a type where printing is performed on a printed tape layer of the base material tape without using the cover tape (a type where the adhesion is not performed).

In addition, the configuration of the tape cassette 5 is not limited to the above configuration. For example, a long flat paper-like or strip-like tape or sheet (including those formed by reeling out a tape wound on a reel and cutting the same into an appropriate length) may be stacked in a predetermined accommodation unit (in a flat stacking form on a tray or the like, for example) to be made into a cartridge, and the cartridge may be mounted to a cartridge holder on the printing apparatus 1-side so that the tape or sheet is transferred and conveyed from the accommodation unit for performing printing.

In addition, the configuration where the roller holder 22 is moved so as to come close to and separate from the print head unit 13 by the lever 17 is adopted. However, a configuration where the print head unit 13 is moved so as to come close to and separate from the roller holder 22 can also be adopted.

Also, other than those mentioned above, methods of the above embodiment and each of the modified embodiments may be combined for use as appropriate.

Although not specifically exemplified, the present disclosure can be put into practice with various changes made within a range not departing from the spirit of the present disclosure.

What is claimed is:

1. A printing apparatus comprising:

a conveying unit configured to convey a printing medium, the conveying unit including a first roller mechanism and a second roller mechanism, and the second roller mechanism being arranged downstream of the first roller mechanism with respect to a conveying direction;

a print head configured to perform printing on the printing medium being conveyed by the conveying unit; and a displacement mechanism configured to displace the first roller mechanism and the second roller mechanism to a close position at which the first roller mechanism and the second roller mechanism are close to the print head and to a separated position at which the first roller mechanism and the second roller mechanism are more distant from the print head than at the close position, wherein the first roller mechanism includes:

a first shaft part which is rotatably supported, the first shaft part being rotatable about a first shaft center extending in a first shaft center direction, and the first shaft part having a first gear at a portion on a first side along the first shaft center direction; and a first roller which is rotatably supported, the first shaft part being inserted in the first roller, and the first roller being configured to be moved in directions coming close to and being separated from the print head by the displacement mechanism, and wherein the second roller mechanism includes:

a movable holder configured to be moved in directions coming close to and being separated from the printing medium by the displacement mechanism;

a second shaft part which is rotatably supported on the movable holder, the second shaft part being rotatable about a second shaft center extending in a second shaft center direction, and the second shaft part having a second gear at a portion on the first side along the second shaft center direction;

a second roller having a hollow cylindrical shape, the second shaft part being inserted in the second roller, the second roller being tiltable with respect to the second shaft center of the second shaft part, and the second roller having an engaging groove recessed in an inner peripheral surface of an intermediate part of the second roller in the second shaft center direction; and a protrusion protruding from an outer peripheral surface of the second shaft part and engaged with the engaging groove of the second roller, wherein rotation of the second shaft part is transmitted via the second shaft part, the protrusion, the engaging groove, and the second roller in this order, and wherein the protrusion protrudes radially more than a portion with the largest diameter of the second shaft part between two ends of the second roller in the second shaft center direction.

2. The printing apparatus according to claim 1, wherein the displacement mechanism includes a roller holder configured to swing, thereby moving the first roller mechanism and the second roller mechanism in the directions coming close to and being separated from the print head, wherein the first roller mechanism is provided to the roller holder, wherein the first roller is rotatably supported on the roller holder, the first roller being configured to be moved in the directions coming close to and being separated from the print head by swinging of the roller holder, wherein the second roller mechanism is arranged at a portion of the roller holder on a further downstream side than the first roller mechanism with respect to the conveying direction, and wherein the movable holder is supported by the roller holder and is configured to move in the directions coming close to and being separated from the printing medium.

3. The printing apparatus according to claim 2, wherein the second shaft part of the second roller is made of metal, wherein the protrusion includes a first pin extending in a direction orthogonal to the second shaft center direction, wherein the engaging groove of the second roller is engaged with the first pin, and wherein rotation of the second shaft part is transmitted to the second roller via the first pin and the engaging groove engaged with each other.

4. The printing apparatus according to claim 3, wherein the second roller mechanism further includes a second pin protruding from the outer peripheral surface of the second shaft part, the second pin extending in a direction orthogonal to the second shaft center direction, wherein the second gear is fitted with the second pin, and wherein rotation of the second gear is transmitted to the second shaft part via the second pin fitted to the second gear.

5. The printing apparatus according to claim 4, wherein a phase difference between an extension direction of the first pin of the second shaft part and an extension direction of the second pin of the second shaft part is approximately 90°.

6. The printing apparatus according to claim 2 wherein an end face of the second roller on the first side along the second shaft center direction and an end face of the second gear on a second side opposite to the first side along the second shaft center direction are spaced from each other in the second shaft center direction.

7. The printing apparatus according to claim 2, further comprising:

an urging member arranged between the roller holder and the movable holder, the urging member configured to urge the movable holder toward the printing medium.

8. The printing apparatus according to claim 7, wherein the urging member is configured such that a first pressing force for pressing the movable holder on the first side is greater than a second pressing force for pressing the movable holder on a second side opposite to the first side.

9. The printing apparatus according to claim 2, further comprising:

a moving body configured to swing the roller holder between a retreat position and a print position by moving between a first position and a second position, wherein the moving body has a support part in contact with a surface of the roller holder on an opposite side to a side on which the first roller is arranged, the moving body holding the roller holder so as not to be inclined, and wherein a length of the support part in the second shaft center direction is greater than ½ of a length of the roller holder in the second shaft center direction.

10. The printing apparatus according to claim 9, further comprising:

a third gear meshed with the first gear;

a fourth gear meshed with the second gear; and a frame rotatably supporting the third gear and the fourth gear, wherein the frame has a first through-hole through which a portion of the first shaft part on the first side along the first shaft center direction penetrates and a second through-hole through which a portion of the second shaft part on the first side along the second shaft center direction penetrates, wherein the first shaft part penetrates through the first through-hole so as to be movable in a direction orthogonal to a penetration direction thereof and the second shaft part penetrates through the second through-hole so as to be movable in a direction orthogonal to a penetration direction thereof, wherein when the roller holder is located in the retreat position, the first shaft part is not in contact with a first edge portion of the first through-hole and the second shaft part is not in contact with a second edge portion of the second through-hole, and wherein when the roller holder is located in the print position, the first shaft part is in contact with a first positioning portion provided at the first edge portion and the second shaft part is in contact with a second positioning portion provided at the second edge portion.

11. The printing apparatus according to claim 1:

wherein the second shaft part having solid round rod-shape, and wherein a diameter of the second shaft part is substantially the same between two ends of the second roller in the second shaft center direction.

* * * * *